US009430930B2

(12) United States Patent
Finn

(10) Patent No.: US 9,430,930 B2
(45) Date of Patent: Aug. 30, 2016

(54) DEVICE HAVING A MOISTURE SENSOR

(71) Applicant: Patrick H. Finn, Freeport, FL (US)

(72) Inventor: Patrick H. Finn, Freeport, FL (US)

( * ) Notice: Subject to any disclaimer, the term of this patent is extended or adjusted under 35 U.S.C. 154(b) by 0 days.

(21) Appl. No.: 14/514,216

(22) Filed: Oct. 14, 2014

(65) Prior Publication Data

US 2015/0102930 A1 Apr. 16, 2015

Related U.S. Application Data

(60) Provisional application No. 61/891,098, filed on Oct. 15, 2013.

(51) Int. Cl.
*G08B 21/00* (2006.01)
*G08B 21/20* (2006.01)

(52) U.S. Cl.
CPC ..... *G08B 21/20* (2013.01)

(58) Field of Classification Search
None
See application file for complete search history.

(56) References Cited

U.S. PATENT DOCUMENTS 6,632,347 B1 * 10/2003 Buckley ..... C02F 1/46104 205/335
2009/0140866 A1 * 6/2009 Heilmann ..... G01M 3/186 340/605
2010/0106319 A1 * 4/2010 Grohman ..... F24F 11/0086 700/276
2013/0155138 A1 * 6/2013 Batchelor ..... B41J 29/02 347/17
2014/0253336 A1 * 9/2014 Ophardt ..... A47K 5/12 340/573.1

* cited by examiner

*Primary Examiner* — Ojiako Nwugo
(74) *Attorney, Agent, or Firm* — Mintz Levin Cohn Ferris Glovsky and Popeo, P.C.

(57) ABSTRACT

Described herein is a device including a collection element having a base with an upper surface surrounded by one or more raised edges near a perimeter of the base, the upper surface having a concavity. The device has a sensor positioned in fluid communication with the concavity in the upper surface of the base. The sensor is configured to detect moisture and to trigger a notification of a user that moisture has been detected by the sensor. The user can be remote from the device and the notification triggered of the moisture detected can be sent remotely to the user. Related apparatus, system, methods and/or articles are described.

14 Claims, 5 Drawing Sheets

DEVICE HAVING A MOISTURE SENSOR

REFERENCE TO PRIORITY DOCUMENT

This application claims priority of U.S. Provisional Patent Application Ser. No. 61/891,098, filed Oct. 15, 2013. The disclosure of the provisional patent application is hereby incorporated by reference in its entirety.

FIELD

The subject matter described herein relates to moisture detection. In particular, devices having moisture detection and remote notification capabilities.

BACKGROUND

Drip pans serve to capture fluids. For example, many appliances, such as washing machines, air conditioners, refrigerators, and the like, may be configured with a drip pan to capture any water or other fluid that might leak from the appliance and cause damage. Drip pans may also be used under sinks and other areas where water damage prevention is desired.

SUMMARY

Devices, methods and apparatus, including computer program products, are provided that include collection elements having a moisture sensor.

In one aspect, there is provided a device including a collection element having a base having an upper surface surrounded by one or more raised edges near a perimeter of the base, the upper surface having a concavity. The device has a sensor positioned in fluid communication with the concavity in the upper surface of the base. The sensor is configured to detect moisture and to trigger a notification of a user that moisture has been detected by the sensor.

The user can be remote from the device and the notification triggered of the moisture detected is sent remotely to the user. The notification sent remotely can be an alert or alarm presented on a secondary device that is remote from the sensor. The sensor can include an electronic sensor configured to electronically communicate with a secondary device to trigger the notification. The secondary device can be a processor-based device. The sensor can communicate wirelessly to secondary device to trigger the notification. The concavity in the upper surface of the base can be contoured such that fluid collected in the collection element is directed towards the sensor. The sensor can be located in the center of the collection element.

The device can further include at least a second sensor positioned on the upper surface of the base, the at least a second sensor configured to detect moisture and to trigger a notification to the user that moisture has been detected by the at least a second sensor. The device can further include a first set of one or more channels on the upper surface of the collection element forming an array around the sensor and a second set of one or more channels on the upper surface of the collection element forming a second array around the at least a second sensor. The first set of one or more channels can be located within the concavity and the second set of one or more channels can be located within a second concavity. The device can further include one or more channels on the upper surface of the collection element. The one or more channels can include a shallow trough shaped into the upper surface of the base to allow for collection of fluid in the collection element and to cause fluid to travel towards the sensor. The one or more channels can form an array around the sensor. The sensor can include a chemical sensor configured to undergo a color change upon contact with a fluid providing the notification to the user. The sensor can be an elongated test strip having a first portion positioned near the center of the concavity in the upper surface of the collection element and a second portion extending toward one of the one or more raised edges. The second portion of the elongated test strip can be visible to the user when the device is in use. The sensor can be litmus paper. The device can be a drip pan.

In an interrelated aspect, described is a method of moisture detection. The method includes collecting an amount of fluid in a collection element configured to be positioned adjacent an appliance. The method includes directing the amount of fluid along at least a portion of the collection element to contact a moisture sensor positioned on the collection element. The method includes detecting the amount of fluid with the moisture sensor. The method includes triggering a notification to a user that the amount of fluid was detected. The user is remote from the sensor.

The above-noted aspects and features may be implemented in systems, apparatus, methods, and/or articles depending on the desired configuration. The details of one or more variations of the subject matter described herein are set forth in the accompanying drawings and the description below. Features and advantages of the subject matter described herein will be apparent from the description and drawings, and from the claims.

Figure 1A:
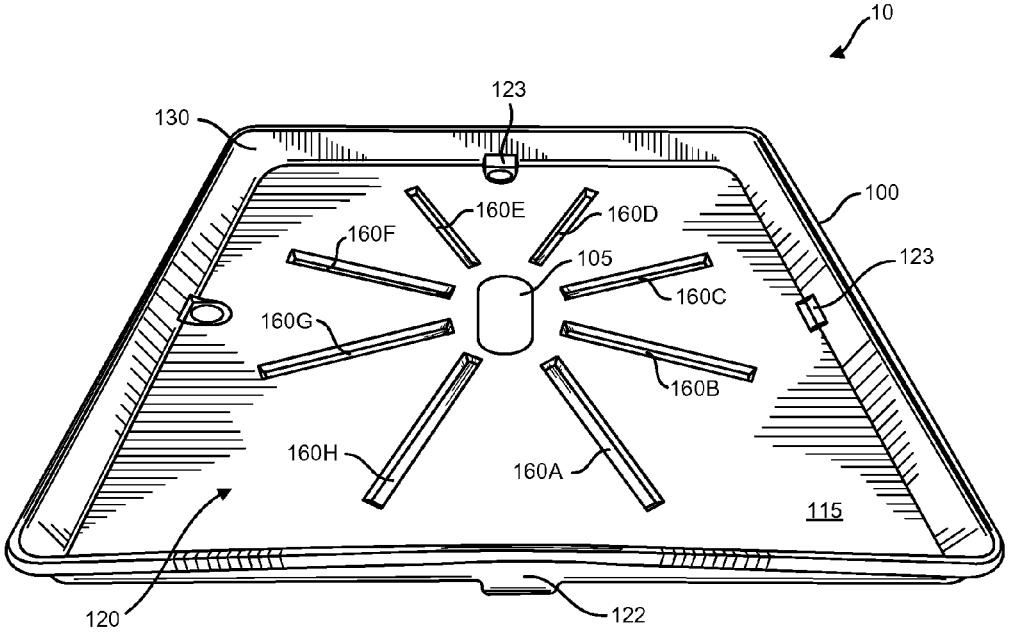
FIG. 1A depicts a top view of a device including a moisture sensor, in accordance with some exemplary embodiments.

Like labels are used to refer to same or similar items in the drawings.

DETAILED DESCRIPTION

Described herein are fluid collection devices, such as drip pans, that can capture fluids from various sources, for example, household appliances, such as washing machines, air conditioners, refrigerators, sinks, etc. The devices described herein can also be used with laboratory equipment, industrial equipment or any other machinery that may incorporate fluids and be subject to leakage or accumulation of moisture in areas where prevention of water damage is desired. The devices described herein are configured not only to collect any fluid leaked, but also to detect small amounts of accumulated moisture and alert a user to the presence of such moisture. This can be useful in the prevention of mold or wood rot or other issues that arise due to chronic exposure to wet environments. The devices described herein allow for a user to be alerted to even small leaks such that repairs can be performed prior to damage to the surrounding areas occur. The devices described herein can be particularly useful, for example, due to their remote notification capabilities. Once fluid or moisture is detected by the device described herein an end-user, who may be remote from the device, can be notified of the issue such that appropriate repairs can be made. Property owners have an interest in ensuring their property is maintained properly and that no issues go unreported. This is true whether the property owner is occupying the space herself or leasing the space out. The notifications from the devices described herein can be sent immediately to the property owner as soon as the event occurs such that repairs can be made in a timely manner and damage to the property can be mitigated.

Figure 1B:
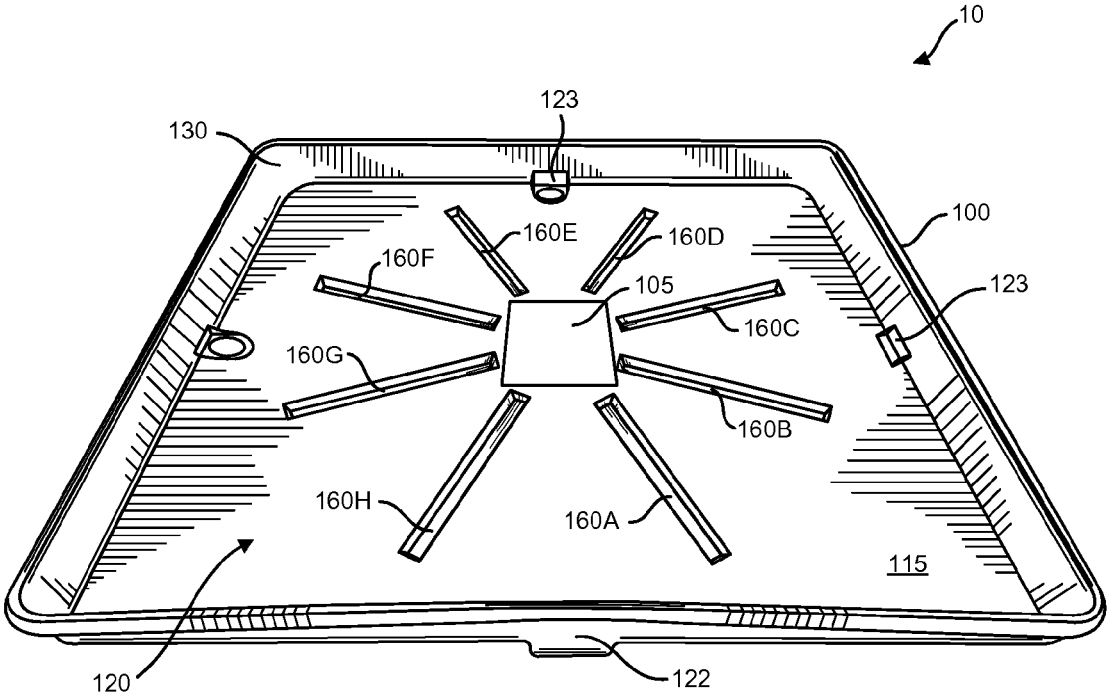
FIG. 1B depicts another top view of a device including another type of moisture sensor, in accordance with some exemplary embodiments.
Figure 2:
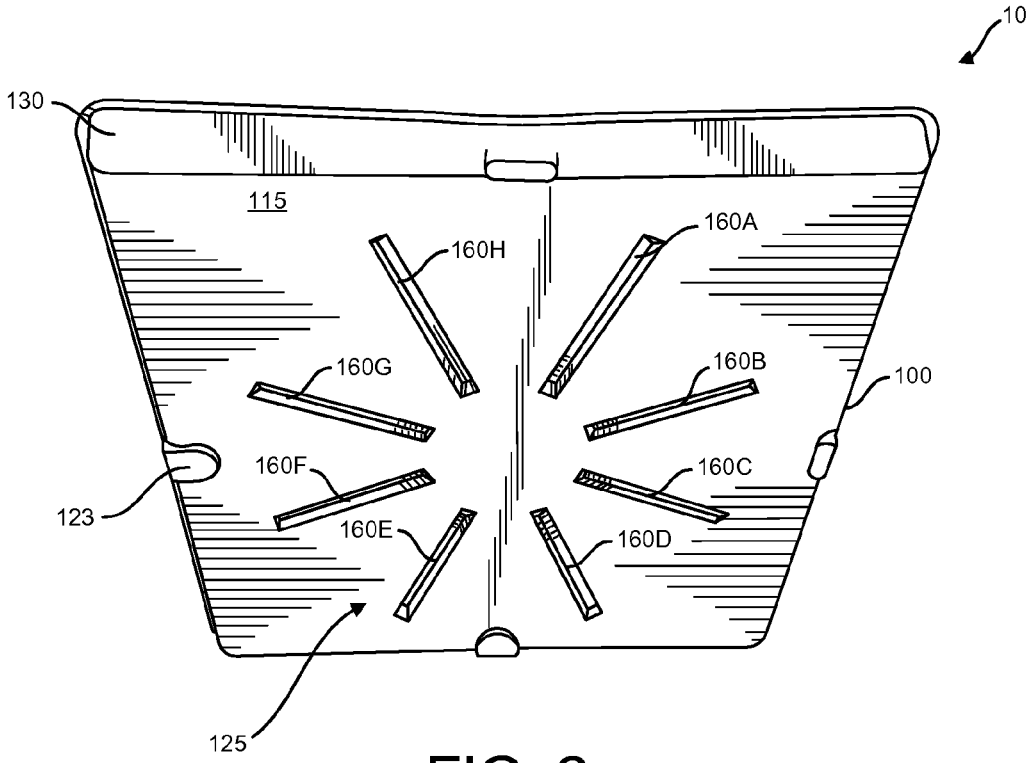
FIG. 2 depicts a bottom view of the device shown in FIGS. 1A and 1B, in accordance with some exemplary embodiments.
Figure 3:
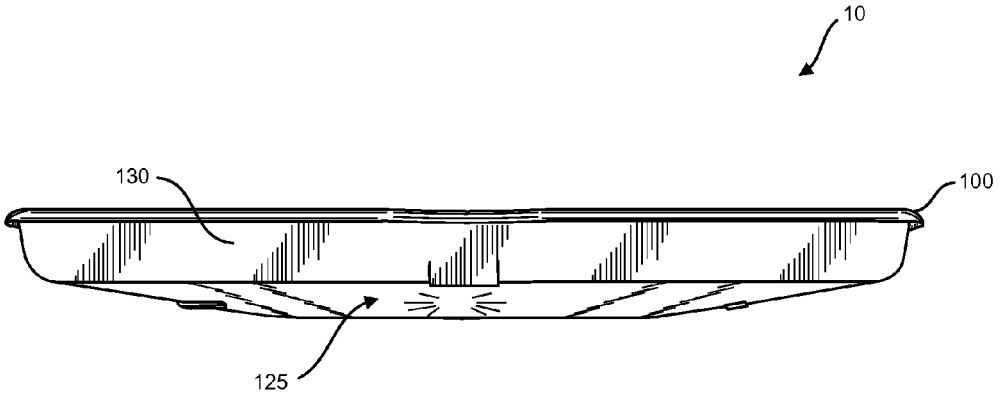
FIG. 3 depicts a right side view of the device shown in FIGS. 1A and 1B, in accordance with some exemplary embodiments.
Figure 4:
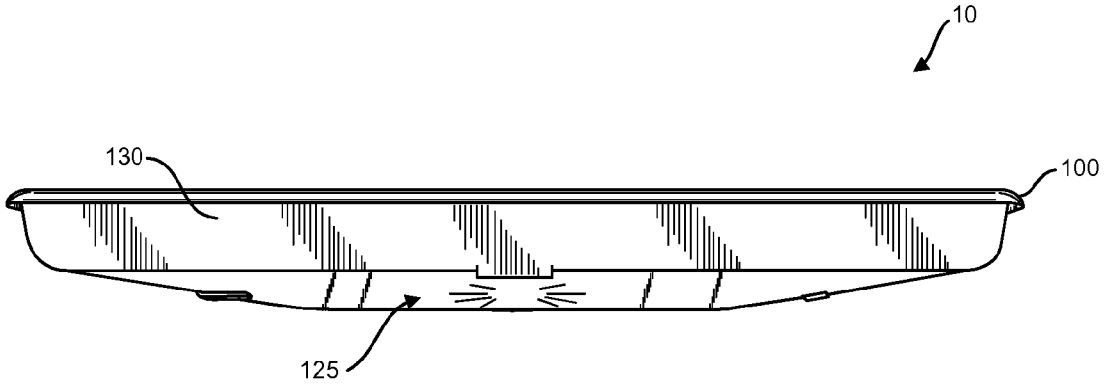
FIG. 4 depicts a left side view of the device shown in FIGS. 1A and 1B, in accordance with some exemplary embodiments.

Now with respect to FIGS. 1A-1B, the device 10 can include a collection element 100 formed of a base 115 having an upper surface 120, a lower surface 125 (best shown in FIGS. 2, 3, and 4), and one or more raised edges 130 near a perimeter of the base 115. The collection element 100 can incorporate one or more moisture sensors 105 positioned in fluid communication with the upper surface 120 of the base 115. The moisture sensor 105 can detect when moisture contacts or collects in the collection element 100. For example, if a fluid, such as water, oil, or other flowable material, makes contact with collection element 100, the fluid can travel towards a particular region of the collection element 100 where the sensor 105 is located to allow the moisture sensor 105 to come in contact and detect the fluid. As will be described in more detail below, once the sensor 105 detects the fluid or moisture it can trigger a notification such as an alert, alarm, color change or other indication to the user that fluid or moisture has been detected.

In some implementations, the device 10 can be a drip pan. However, it should be appreciated that use of the terms "drip pan" or "pan" are not intended to be limiting to a particular material or structural configuration. It should also be appreciated that use of the terms "leak" or "fluid" or "moisture" are also not intended to be limiting. It should be appreciated that very small amounts of moisture as well as larger volumes of fluid that might be encountered during a leak of an appliance or a pipe can be detected by the sensors described herein to trigger a notification of a user.

The material(s) of the collection element 100 can vary including any of a variety of metals and plastics. The base 115 and raised edges 130 of the collection element 100 can be a molded unitary structure or can alternatively be a combination of structures coupled together. For example, the edge(s) 130 of the collection element 100 can be reversibly coupled to the base 115 by one or more fixation elements 123 such that the collection element 100 can be disassembled such as for cleaning. Any of a variety of structural features can be incorporated into the collection element 100, either by molding or coupling, to allow for better handling by the user. For example, as shown in FIGS. 1A-1B, the collection element 100 can incorporate a lip or flange 122 positioned near or on one or more of the edges 130 of the collection element 100 such as the front end in order that the collection element 100 can be more easily inserted and/or removed from under a piece of machinery. FIGS. 1A-1B also show the collection element 100 as having a rectangular shape, although it should be appreciated that the collection element 100 may have other shapes as well, such as circular, elliptical, triangular, and the like. The collection element 100 also can have any of a variety of sizes such that it can be used in a variety of locations and with a variety of equipment.

The upper surface 120 of the pan 100 can be shaped such that the flow of fluid collected on the base 115 is directed towards the region of the base 115 where the sensor 105 is located. In some implementations, one or more regions of the upper surface 120 of the base 115 can be slightly concave forming a concavity. The sensor 105 can be positioned in fluid communication with the concavity in the upper surface of the base, for example near or at a center of the concavity. In some implementations the upper surface 120 has a concave contour and the lower surface 125 is planar. In other implementations, the entire collection element 100 has a concave shape such that a concavity is formed in the upper surface 120 serving to funnel fluid collected on the upper surface 120 towards the sensor 105. FIGS. 1A and 1B show the sensor 105 located near the central portion of the collection element 100, however, the sensor 105 need not be located in the center of the pan 100 and may be located at other locations as well. For example, the pan 100 can be shaped such that the sensor 105 is positioned nearer to one of the raised edges 130 of the pan 100 and the contour of the base 115 shaped to encourage any collected fluid or moisture to flow toward that sensor 105 positioned in its concavity. Similarly, the upper surface 120 of the base 115 can have more than one sensors 105 each positioned within its own concavity such that even a small amount of fluid can make contact with a sensor 105.

Again with respect to FIGS. 1A-1B, the collection element 100 can also include one or more channels 160 such that the fluid collected in the base 115 may also travel via the channels 160 to moisture sensor 105. Each channel 160 can be formed as a shallow trough shaped into the upper surface 120 of the base 115 to allow for collection of even small amounts of fluid that can travel down the channel 160 to sensor 105. Each channel 160 can be positioned within its own concavity or an array of channels 160 can be located in a single concavity. The number of channels 160 can vary including, but not limited to 1, 2, 3, 4, 5, 6, 7, 8, 9, 10 or more channels 160 depending on the overall size of the collection element 100 or the amount of fluid that might be expected to be collected by the collection element 100. Further, the shape, size and spacing from the location of the sensor 105 of the one or more channels 160 can also vary. FIGS. 1A-1B depict 8 channels 160A-H arranged in a starburst array around a sensor 105 located within a concavity in the upper surface 115 of the collection element 100. If the collection element 100 include more than one sensor 105, it should be appreciated that each sensor 105 can incorporate its own channel or channels 160 in separate concavities. In some implementations, the channels 160 extend from near a perimeter region of the collection element 100 towards the location of the sensor 105 such that they can collect any fluid from the base 115 of the pan 100 and cause fluid flow toward the sensor 105 such that the fluid and the sensor 105 can be in contact. As described above, the upper surface 120 of the base 115 can have a concavity or a concave contour towards the region of the pan 100 where the sensor 105 is located. The channels 160 can be positioned within the concave regions.

As mentioned above, upon contact between the moisture or fluid and the sensor 105, a notification is triggered. How triggering occurs may be implemented in a variety of ways and can vary depending on what type of sensor 105 is incorporated into the collection element 100. Triggering of the moisture sensor 105 can result in one or more of the following: an indicator changing to show visibly moisture has been detected; an audible alarm indicating moisture detection; a radio signal, such as a WiFi, cellular, and/or other wireless signal being transmitted to another device to alert the other device (for example, a cell phone, smart phone, handheld device, and any other processor-based device including an interface capable of receiving the notification); a color change to show moisture has been detected, and the like.

The sensor 105 may be implemented in a variety of ways. For example, the sensor 105 can be electronic, electro-mechanical, mechanical, chemical, or a combination thereof. Depending on the implementation of the sensor 105, various additional components can be incorporated including, but not limited to, a plastic casing, power source (battery or AC adapter), a transmitter, visual indicator mechanism, alarm mechanism, vibration mechanism as will be described in more detail below.

In some implementations, the sensor 105 can be an electronic device that communicates with the electronics of the machinery with which the collection element 100 is being used. The sensor 105 can be hard-wired to the electronics of the machinery such that the notification is provided through the machinery itself. Alternatively, the sensor 105 of the collection element 100 can communicate wirelessly to a secondary device. For example, the sensor 105 can communicate with a radio frequency interface such that upon detection of fluid, the sensor 105 can trigger sending a message to a secondary device that is a processor-based device. The secondary device to which the sensor communicates can be the device with which the collection element 100 is being used (e.g. refrigerator, washing machine, etc.) such that the notification to the user is provided using the device's own capabilities. Alternatively, the secondary device can be an electronic device such as a mobile phone, smartphone, tablet, computer, home security system, and the like, having one or more components configured to provide an alert or alarm to the user upon being triggered by the sensor 105. The secondary device, therefore, can be remote from where the event, such as a leak or moisture accumulation, occurred. This is particularly useful for a landlord who is not occupying the space where the moisture is accumulating or the leak has occurred. This can also be useful for a property owner who is away from the property, for example on vacation or at work, or otherwise remote from the property and has a vested interest in knowing straight away the status of their property.

The sensor 105 as well as the electronic components can be located inside a plastic housing coupled to a region of the pan 100. The various components can be coupled to a region of the collection element 100 such that a user can determine relatively easily that the device is on, connected and functioning normally. For example, an LED indicator can be positioned near a front edge of the collection element 100 such that even when slid under a machine the LED is visible. Status of the sensor 105 can also be transmitted in a remote manner to a secondary device.

In other implementations, the sensor 105 can be an electro-mechanical device that detects fluid and provides a notification that moisture or fluid has been detected, such as a visual and/or audible notification or indication. An audible sensor may include a "press to test" button to verify functionality. The audible indicator can include an alarm sound and/or a vibration that is audible to a user.

In other implementations, the sensor 105 may be implemented as a mechanical device and/or use chemical reactions to show moisture has been detected by the sensor 105. In some implementations, the sensor 105 can be a test strip such as litmus paper (see FIG. 1B). Litmus paper permanently changes colors when it comes into contact with a fluid indicating moisture has been detected by the paper. The test strip can be a segment of paper in any of a variety of shapes and sizes. In some implementations, the sensor 105 is an elongated test strip of paper such that a first portion of the sensor 105 is positioned near a region of the collection element 100 towards which the collected fluid is directed (e.g. near the center of the concavity in the upper surface 115) and a second portion of the sensor 105 extends away from the region toward an edge 130. The second portion of the sensor 105 near the edge 130 can be visible to a user when the device 10 is in use such that the change in color would be readily apparent. In some implementations, the sensor 105 can be covered by a clear element, such as a plastic cover, to prevent inadvertent contact between the sensor 105 and any other fluids not associated with the fluid to be detected by the sensor 105. The sensor 105 may be provided with additional sheets of interchangeable litmus paper that can be replaced when used. The user after viewing the color change can remove the plastic cover and slide the used sensor 105 out from a slot within which the sensor 105 is held. A second sensor 105 can be inserted into the same slot such that a distal portion of the sensor 105 extends towards the collection region on the collection element 100 where the fluid is directed and the proximal portion of the sensor 105 remains visible through the plastic covering. It should be appreciated that at least a portion of the sensors described herein can be covered, enclosed, or protected by an element such as the plastic covering described above.

In some implementations, an aperture can be formed in the collection region of the collection element 105. The aperture can extend through the collection element 105 from the upper surface 115 to the lower surface 125. The sensor 105 can be inserted until the distal portion of the sensor 105 is aligned with the aperture such that it can come into contact with the fluid collected on the upper surface 115. The proximal portion of the sensor 105 can extend away from the aperture toward the edge 130, for example under a plastic window. Any of a variety of structural guides and features can be incorporated into the pan 100 to accommodate such a sensor 105 and maintain the sensor 105 in alignment with the aperture and the plastic window. In some implementations, a secondary planar structure can be coupled to the lower surface 125 of the base 115 such that the test strip sensor 105 is sandwiched therebetween.

It should be appreciated that the mechanical device and/or the chemical reaction of the sensor 105 can vary and is not intended to be limited to litmus paper. For example, other fluid wicking materials are considered herein, including, but not limited to various porous papers, sintered polymers, plastics, fabrics, fibers, and other structures or materials capable of lateral flow of fluid. Similarly, various indicator mechanisms are considered herein, including, but not limited to various dyes, colored particles, and chemical indicators of the fluid to be detected or one or more components of the fluid to be detected.

While this specification contains many specifics, these should not be construed as limitations on the scope of what is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results. Only a few examples and implementations are disclosed. Variations, modifications and enhancements to the described examples and implementations and other implementations may be made based on what is disclosed.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together."

Use of the term "based on," above and in the claims is intended to mean, "based at least in part on," such that an unrecited feature or element is also permissible.

What is claimed:

1. A device, comprising:

a removable drip pan forming a collection element comprising a base having an upper surface surrounded by one or more raised edges near a perimeter of the base, the upper surface having a concavity and an array of channels located within the concavity; and a sensor positioned within the concavity in the upper surface of the base and surrounded by the array of channels, the sensor configured to detect moisture and to trigger a notification of a user that moisture has been detected by the sensor, wherein each channel of the array of channels forms a shallow trough shaped into the upper surface to direct fluid collected in the collection element towards the sensor positioned within the concavity and surrounded by the array of channels.

2. The device of claim 1, wherein the user is remote from the device and the notification triggered of the moisture detected is sent remotely to the user.

3. The device of claim 2, wherein the notification sent remotely comprises an alert or alarm presented on a secondary device that is remote from the sensor.

4. The device of claim 1, wherein the sensor comprises an electronic sensor configured to electronically communicate with a secondary device to trigger the notification.

5. The device of claim 4, wherein the secondary device is a processor-based device.

6. The device of claim 5, wherein the sensor communicates wirelessly to secondary device to trigger the notification.

7. The device of claim 1, wherein the sensor is located in the center of the collection element.

8. The device of claim 1, wherein the sensor comprises a chemical sensor configured to undergo a color change upon contact with a fluid providing the notification to the user.

9. The device of claim 8, wherein the sensor is litmus paper.

10. The device of claim 1, wherein the collection element is configured to collect the fluid from above the collection element and prevent the fluid from contacting a surface below the collection element.

11. A method of moisture detection using a removable drip pan, the method comprising:

collecting an amount of fluid in a collection element configured to be positioned under an appliance and having a concavity in an upper surface and an array of channels located within the concavity;

directing the amount of fluid along the array of channels located within the concavity of the collection element towards a moisture sensor positioned within the concavity and surrounded by the array of channels;

detecting the amount of fluid with the moisture sensor; and triggering a notification to a user that the amount of fluid was detected;

wherein the user is remote from the sensor.

12. The method of claim 11, wherein triggering a notification to a user comprises presenting on a secondary device an alert or alarm to the user.

13. The method of claim 12, further comprising electronically communicating with the secondary device with the sensor to trigger the notification.

14. The method of claim 13, wherein electronically communicating comprises wirelessly communicating to the secondary device.

* * * * *